US005620044A

United States Patent [19]

Grenkowitz et al.

[11] Patent Number: 5,620,044

[45] Date of Patent: Apr. 15, 1997

[54] GRAVITY PRECISION SAND CASTING OF ALUMINUM AND EQUIVALENT METALS

[75] Inventors: Robert W. Grenkowitz, Washington; Michael J. Braskich, Grosse Ile; Allen D. Ackerman, Troy, all of Mich.

[73] Assignee: Ford Motor Company, Dearborn, Mich.

[21] Appl. No.: 319,901

[22] Filed: Oct. 7, 1994

[51] Int. Cl.[6] ..... B22D 37/00

[52] U.S. Cl. ..... 164/134; 164/358

[58] Field of Search ..... 164/134, 358, 164/352, 353, 354, 355

[56] References Cited

U.S. PATENT DOCUMENTS

| | | | |
|---|---|---|---|
| 486,327 | 11/1892 | Cushing et al. | 164/355 |
| 790,202 | 5/1905 | Griffith . | |
| 1,347,168 | 7/1920 | Kuznik . | |
| 1,385,201 | 7/1921 | Chapple . | |
| 1,543,657 | 6/1925 | Bohn et al. . | |
| 1,948,653 | 2/1934 | Emery et al. . | |
| 2,233,405 | 3/1941 | Fahlman . | |
| 3,752,221 | 8/1973 | Copley et al. . | |
| 4,112,997 | 9/1978 | Chandley | 164/358 |
| 4,509,906 | 4/1985 | Hattori et al. . | |
| 4,726,788 | 2/1988 | Svoboda et al. . | |
| 4,736,788 | 4/1988 | Svoboda et al. | 164/134 |
| 4,804,032 | 2/1989 | Wilkins . | |
| 4,842,037 | 6/1989 | Brown et al. . | |
| 4,967,827 | 11/1990 | Campbell . | |
| 5,072,773 | 12/1991 | Ruff et al. . | |

FOREIGN PATENT DOCUMENTS

| | | | |
|---|---|---|---|
| 0101345 | 2/1984 | European Pat. Off. . | |
| 0109823 | 5/1984 | European Pat. Off. . | |
| 2011788 | 3/1970 | France . | |
| 2589527 | 3/1987 | France . | |
| 2637947 | 4/1990 | France . | |
| 58-68454 | 4/1983 | Japan | 164/134 |
| 63-52744 | 3/1988 | Japan | 164/358 |
| 223 | of 1863 | United Kingdom | 164/353 |
| 2143279 | 2/1985 | United Kingdom . | |

*Primary Examiner*—Kuang Y. Lin
*Attorney, Agent, or Firm*—Joseph W. Malleck

[57] ABSTRACT

A technique and accompanying apparatus to promote increased yield, improved surface finish and microstructure, and faster cycling time for precision-sand casting process. Aluminum products are cast by: (a) forming a precision sand mold, devoid of risers and/or vents, and a gating system consisting of a gravity feeding sprue and one or more runners effective to carry molten metal from the sprue only to the bottom of the mold cavity; (b) planting a flow modifier in the gating system between the sprue and mold effective to convert the flow into laminar quiescent flow; and (c) filling the gating system with molten aluminum metal at a rate faster than 4 pounds/second as permitted by the laminar flow that more rapidly fills the mold and acts as a heat sink to prevent a drop in temperature of the in-coming molten metal and thereby increase yield as well as minimizing cycle time.

9 Claims, 4 Drawing Sheets

GRAVITY PRECISION SAND CASTING OF ALUMINUM AND EQUIVALENT METALS

BACKGROUND OF THE INVENTION

1. Technical Field

This invention relates to using core sand for precision molding of metal castings, particularly aluminum, and more particularly to enhancement of metal yield, metal properties and quality features such as surface finish using such casting technique.

2. Discussion of the Prior Art

Precision-type sand casting (using core type sand such as zircon or silica) is known and has been used for at least 50 years in the commercial production of automotive castings, such as cylinder heads and blocks. This technique has many advantages, but it leaves certain features to be desired, such as increasing yield and improving the microstructure or surface finish of the casting, and increasing the speed of producing castings by such technique.

Risers, and to a lesser extent venting, have regularly been required in the molding system when sand casting aluminum. This is mandated to avoid shrinkage and pin holes in the solidifying regions. The risers serve as a molten reserve of aluminum that stays hotter to feed such regions. Unfortunately such risers adversely affect yield of the process.

Such sand casting processes usually rely on gravity to feed molten metal to a runner system with the pressure head from the metal filling the sprue serving to provide a low level of pressurization for the metal in the runners. Due to the need to fill the risers during the pour, the cycle is slowed, allowing the molten temperature to drop and reach adverse temperature levels, particularly near the end of the mold filling. Thus, it is traditional to pour at higher metal temperatures to compensate for this aspect. This results in (i) a poorer surface finish, (ii) a poorer microstructure in the last metal to solidify, and (iii) poor production cycling.

The gravity runner system typically has abrupt changes in direction of sections of the runner system; again, the metal must be poured at higher temperatures to maintain good fluidity over the slower cycle of the casting pour; this results in a flow that is somewhat turbulent. Heat is readily transferred to the sand walls of the mold, often causing the sand particles to fracture, leading to poor surface finish for the metal casting. The higher pouring temperature tends to produce poorer metal microstructure in the regions last to solidify, producing a microstructure with wider dendritic arm spacing than desired.

SUMMARY OF THE INVENTION

This invention provides a technique and accompanying apparatus to solve the above problems while achieving increased yield, improved surface finish and microstructure, and faster cycling time for the casting process. The invention in a first aspect is a method of casting aluminum products comprising: (a) forming a precision sand mold, devoid of risers and/or vents, and a gating system consisting of a gravity feeding sprue and one or more runners effective to carry molten metal from the sprue only to the bottom of the mold cavity; (b) planting a flow modifier in the gating system between the sprue and mold runner system to convert the flow into laminar quiescent flow; and (c) filling the gating system with molten aluminum metal at a rate in the range of 4–15 pounds per second as permitted by the modifier that allows laminar flow to more rapidly fill the mold and that acts as an insulator to prevent a drop in temperature of the in-coming molten metal and thereby increase yield as well as minimizing cycle time.

A second aspect of this invention is an improved molding apparatus, comprising: (a) a precision sand mold devoid of risers and/or vents and having a mold cavity; (b) a runner system feeding the bottom of the mold at the largest metal regions of the mold cavity; (c) a sprue for gravity feeding of molten metal to the runner and; (d) a flow modifier between the sprue and runners to effect laminar quiescent flow of the molten metal, to effect filtering of dross from the molten metal; and to retain heat as an insulator to permit lowering the pouring temperature of the molten metal.

DETAILED DESCRIPTION AND BEST MODE

Figure 1A:
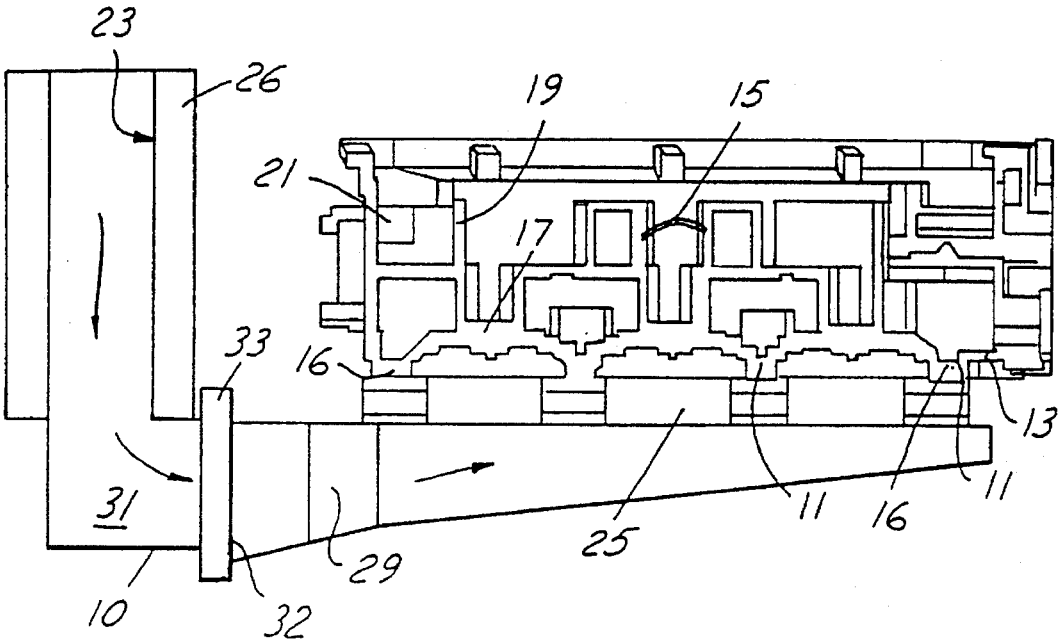
FIG. 1A is a vertical sectional view of a mold and gating system to produce an automotive engine head casting, the mold and system embodying the principles of this invention.
Figure 1B:
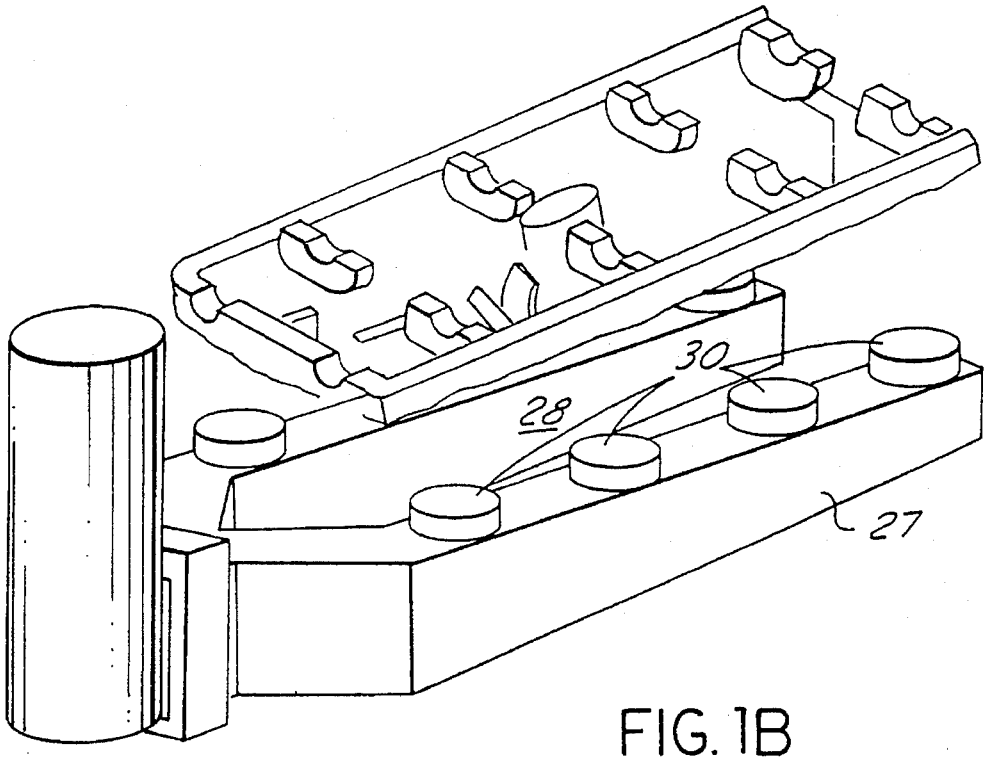
FIG. 1B is a perspective schematic illustration of the gating system of FIG. 1A showing the mold cavity broken away from the runner system.
Figure 2:
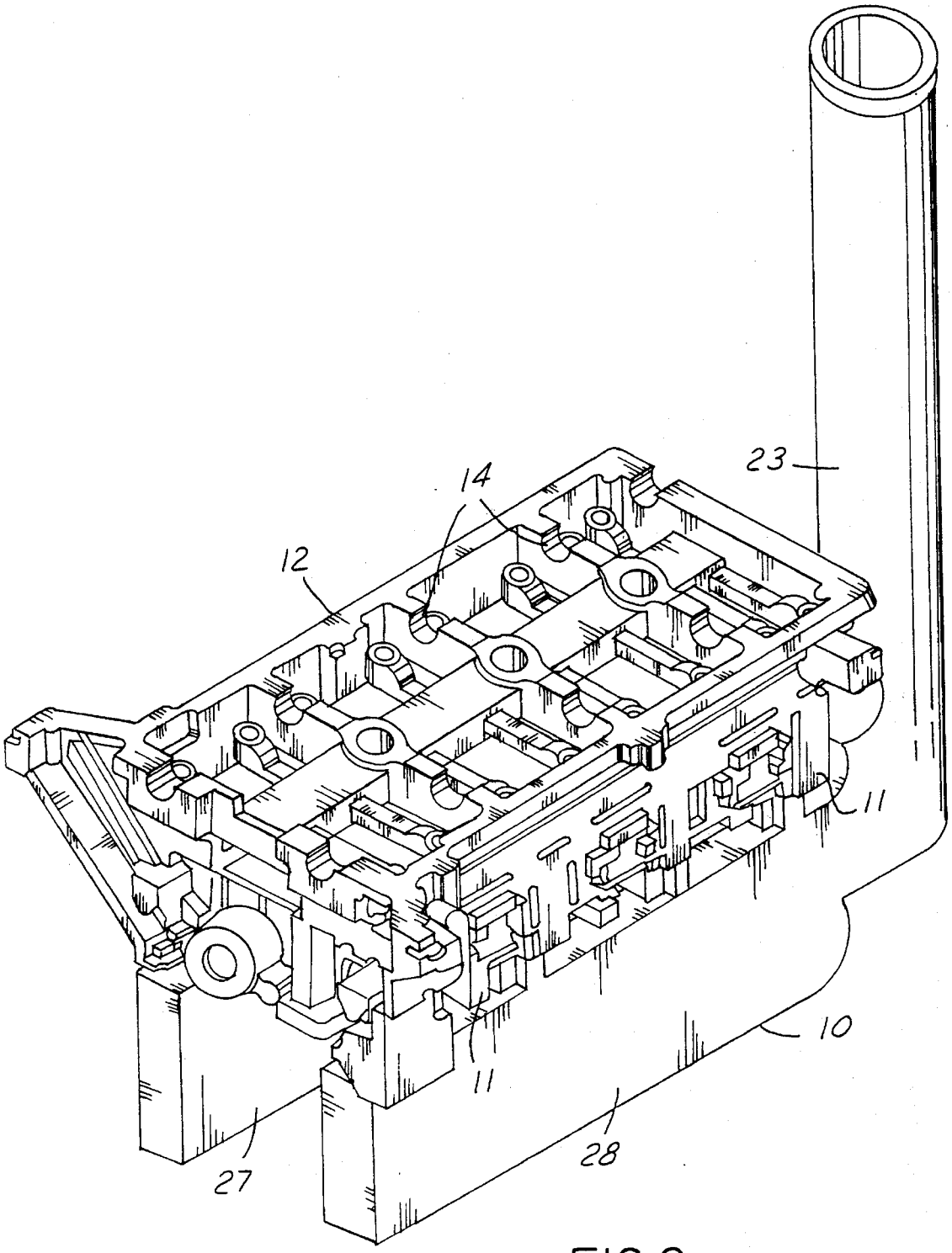
FIG. 2 is a reversed perspective illustration of the gating and mold system of FIG. 1.

The gating system 10 (and FIG. 1B) must feed the largest to-be-cast metal masses 11 at the bottom of the mold cavity 12. This is necessary because of the conditions of directional solidification. For an automotive engine head casting, as shown in FIGS. 1 and 2, the casting cavity 12 desirably is oriented with the head deck 13 down; upright camtowers 14 are spaced at intervals 15 along the length of the head and bolt bosses 16 are aligned with the camtowers 14 to create enlarged metal mass zones which, for this casting, are the largest masses 11 adjacent the head deck. Concave combustion chamber roofs 17 are located between the camtowers 14, extending away from the head deck 13. The combustion chamber wall cavity and spark ignition sockets 19 as well as other cavities for valve train seats present complex internal shapes and demand optimum metal microstructure in the final casting.

The casting cavity is defined by the use of core-type sand (such as zircon or silica) walls 21; such sand walls are fabricated by conventional core making techniques.

The gating system 10 depends upon the gravity pressure head pushing the molten metal (such as 356, 319, or other aluminum casting alloys) down a vertical sprue 23 to a horizontally extending runner system 27–28 that feeds the bottom 25 of the mold at the large mass zones 11. The sprue 23 should accept sufficient molten metal (such as at a temperature of no greater than 1400° F.) so that the filling of the mold can take place within minimum time and provide a pressure head sufficient to feed the casting while maintaining an excellent surface finish. For the head casting cavity which here has an aluminum metal weight of about 35–45 pounds, the sprue internal diameter is about 1½ inches. To retain metal heat the sprue 23 can be insulated by a liner 26. The runner system may be split into two (or more) runner arms 27,28 to directly carry molten metal to the precise desired bottom locations of the mold cavity in a streamlined flow 29. Shallow ingates 30 (vertical channels) extend from the runners to connect the top of the runner arms 27,28 to the large mass zones 11 at the bottom of the mold cavity. The runners have a cross-sectional area of about six square inches which will taper to about three square inches for feeding the last of the ingates of the cylinder head example.

Figure 3:
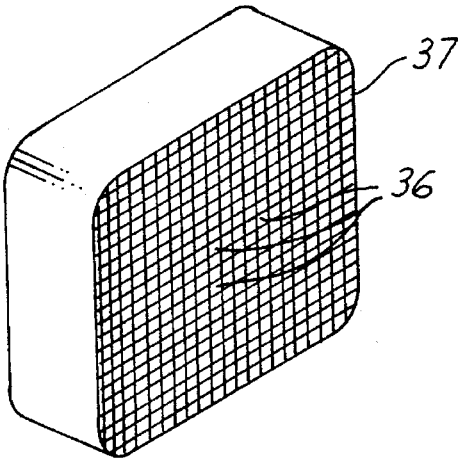
FIG. 3 is an enlarged perspective illustration of the flow modifier utilized in FIGS. 1 and 2.
Figure 4:
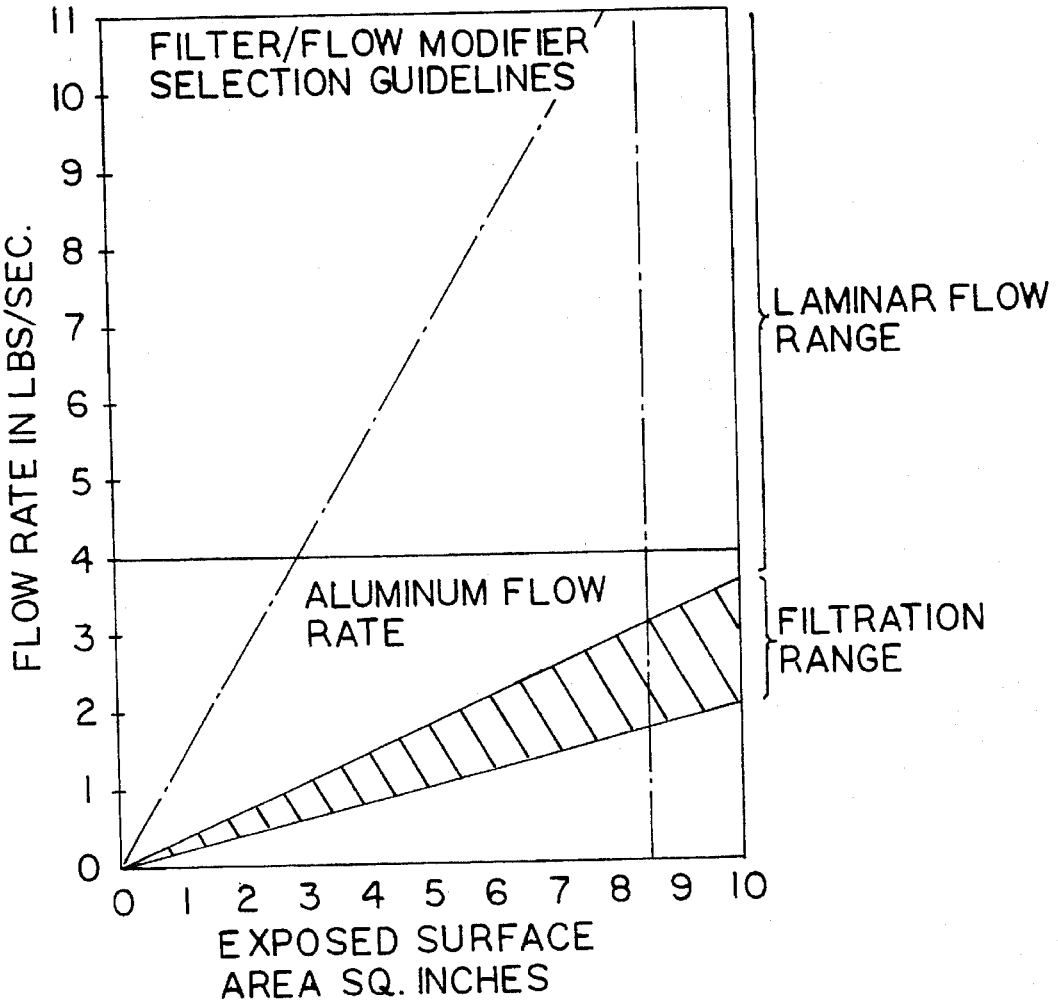
FIG. 4 is a graphical illustration of the relationship between aluminum flow rate and exposed surface area of the flow modifier for providing laminar flow in distinction to filtration.
Figure 5:
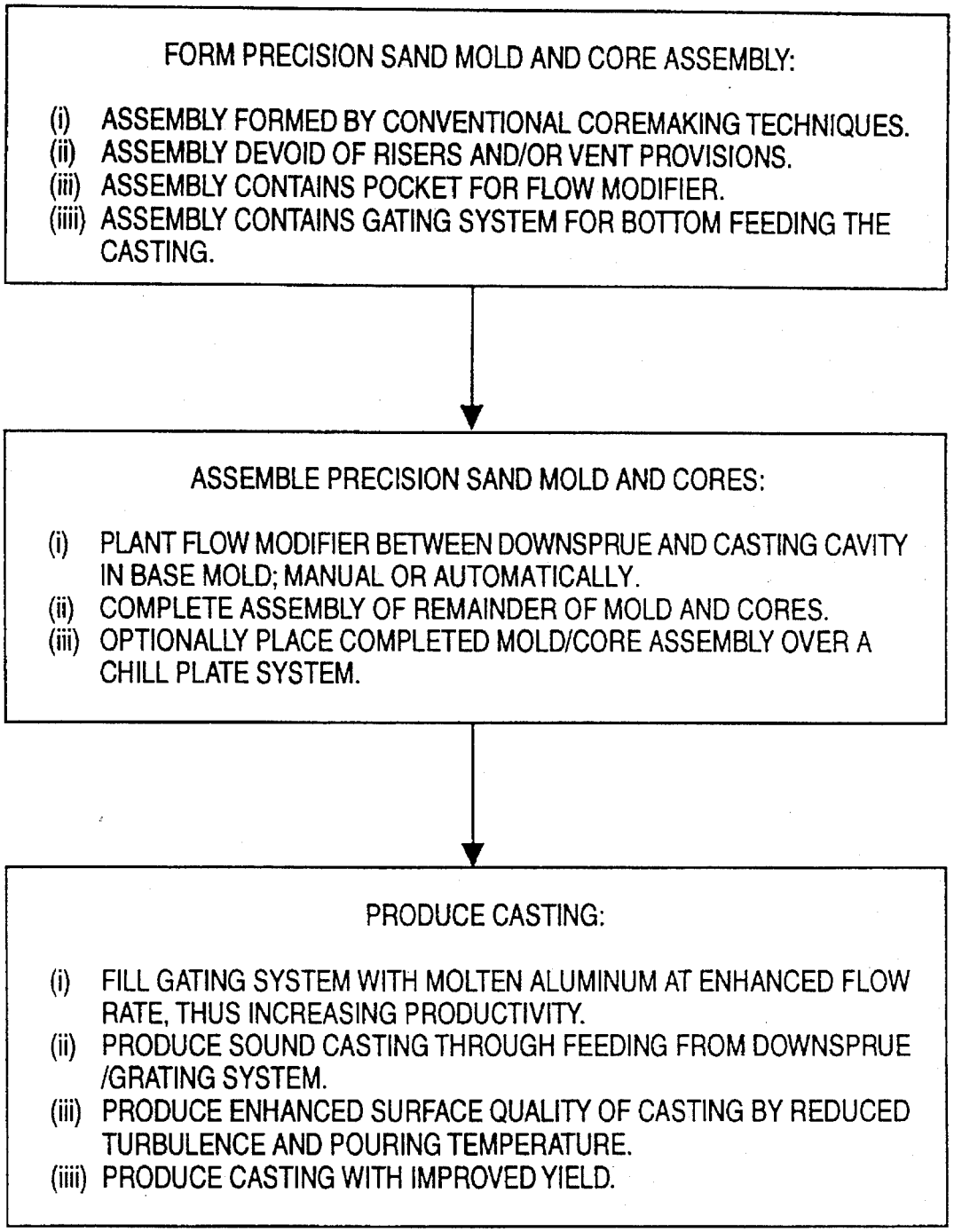
FIG. 5 is a flow diagram illustrating the method steps of casting aluminum products according to the invention herein.

The sprue 23 has an enlarged base chamber 31 to facilitate transition of the molten metal to a horizontal flow; at the sides of the base chamber which connects to the entrance 32 to the runner system 27,28, is located a flow modifier 33 that extends across the flow area normal to the axis 29 of the flow. The flow modifier 33 is constructed to have a multitude of parallel equi-sized minute passages that promote laminar flow to the molten metal passing therethrough (see FIG. 3). Such modifier may be fabricated of a high temperature extruded cellular ceramic, in various cell densities (about 300 cells per square inch). The modifier preferably has an open or porous area 36 that is about 50–80 percent of its total frontal exposed area 37. Such frontal exposed area 37 is preferably about 2–6 times the total choke area 38 (transition cross-sectional from sprue to runner) of the gating system. Such porous area is also effective to filter, from the molten metal, slag dross and other non-metallic inclusions. Heretofore it has been believed that flow modifiers will lose their ability to filter molten metal at flow rates exceeding 4.0 pounds per second. However, forming the modifier openings in squares or rectangles, and with the ratio of porosity to total area 0.5–0.8, the modifier can convey molten aluminum at higher rates flow with effective filtering of dross and slag (see FIG. 4). Thus, the modifier allows laminar flow to more rapidly fill the mold and also act as an insulator to prevent a drop in temperature of the incoming molten metal.

Such pouring rate permits an aluminum shot of about 75 pounds to be poured in 9 seconds (2 seconds to generate the head height and 7 seconds to deliver the molten metal through the sprue); see FIG. 6.

To ensure enhanced metal microstructure at critical head surfaces, such as combustion chambers, a cooled chill plate can be planted in the mold to define such surfaces.

We claim:

1. A method of casting aluminum products, comprising:

(a) forming a precision sand mold devoid of at least one of risers and vents, and a gating system consisting of a gravity feeding sprue and one or more runners effective to carry molten metal from said sprue only to the bottom of the mold cavity;

(b) planting a flow modifier in said gating system between the sprue and mold cavity to convert said flow into laminar flow, said modifier having an open porous area and a total frontal exposed area, wherein said open porous area is 50–80% of said total frontal exposed area; and (c) filling said gating system with molten aluminum metal at an enhanced pour rate permitted by said modifier that allows laminar flow to more readily fill the mold and that acts as a heat retaining insulator to keep the incoming molten metal at a higher temperature level thereby to minimize cycle time and improve the yield of the casting process.

2. The method as in claim 1, in which said flow modifier permits said molten aluminum to be poured at a lower temperature using the molten metal in the runner as a shrink compensator during solidification.

3. The method as in claim 1, in which said modifier is constructed of a ceramic material having a cell density of about 300 cells/in$^2$ and an open porous area appropriate for the pouring rate that is effective to filter said flow while promoting laminar flow.

4. The method as in claim 3, in which said flow modifier has cells with an open cross-sectional shape that is rectangular promoting laminar flow and also filter dross, slag and non-metallic inclusions from said molten aluminum.

5. The method as in claim 1, in which the frontal exposed area of said modifier is 2–6 times the transitional cross-sectional area between the sprue and runner.

6. The method as in claim 1, in which said molten metal is filled in step (c) at a temperature of no greater than 1400° F.

7. The method as in claim 1, in which the aluminum metal is selected from the group of 356, 319 or other aluminum casting alloys.

8. An improved molding apparatus for casting aluminum products, comprising:

(a) a precision sand mold devoid of risers and vents;

(b) a runner system feeding the bottom of said mold at the largest metal mass zones of the mold cavity;

(c) a sprue for gravity feeding of molten metal to the runners and;

(d) a flow modifier between said sprue and runners to effect laminar quiescent flow of the molten aluminum metal, to filter said molten metal of dross, slag and non-metallic inclusions from the molten aluminum metal, and to retain heat as an insulator to permit lowering the pouring temperature of the molten metal wherein said modifier having an open porous area and a total frontal exposed area, wherein said open porous area is 50–80% of said total frontal exposed area.

9. Method of sand casting a precision aluminum product, using a sand mold devoid of at least one of riders and vents and having a casting cavity, comprising:

(a) forming a sand gating system for said mold consisting of a gravity feeding sprue and one or more runners effective to carry a molten metal flow from said sprue to the bottom of said mold cavity;

(b) planting a flow modifier in said gating system between said sprue and runners to convert said flow into laminar flow, said modifier being constituted of an insulating material effective to retain heat of the initial molten metal passing therethrough for release to later molten metal so as to insure fluidity wherein said modifier having an open porous area and a total frontal exposed area, wherein said open porous area is 50–80% of said total frontal exposed area.

* * * * *